United States Patent [19]

Leopold

[11] 4,366,697

[45] Jan. 4, 1983

[54] PRESS FOR PRODUCING WORKPIECES FROM WIRE SEGMENTS

[76] Inventor: Wilhelm Leopold, Im Vogelsholz 50, 5600 Wuppertal 21, Fed. Rep. of Germany

[21] Appl. No.: 252,241

[22] Filed: Apr. 8, 1981

[30] Foreign Application Priority Data

Apr. 8, 1980 [DE] Fed. Rep. of Germany ..... 3013472
Jun. 23, 1980 [DE] Fed. Rep. of Germany ..... 3023371

[51] Int. Cl.[3] ..... B21D 22/00

[52] U.S. Cl. ..... 72/361; 72/354; 72/434

[58] Field of Search ..... 72/354, 361, 433, 434, 72/422, 428

[56] References Cited

U.S. PATENT DOCUMENTS

| | | | |
|---|---|---|---|
| 2,174,970 | 10/1939 | Cornell, Jr. | 72/434 |
| 3,247,851 | 2/1969 | Michelson | 72/434 |
| 3,972,216 | 8/1976 | Messerschmidt | 72/361 |
| 4,306,443 | 12/1981 | Matsutani | 72/434 |

*Primary Examiner*—Leon Gilden
*Attorney, Agent, or Firm*—Becker & Becker, Inc.

[57] ABSTRACT

A press for producing workpieces from wire segments. The press includes a stationary matrix, a press carriage drivable back and forth, a crankshaft drive for the press carriage, a stamp leading the press carriage and drivably connected therewith, a spring effecting the leading of the stamp relative to the press carriage, and a feed or supply device for wire segments. A buffer resiliently yieldable in the pressing direction is associated with the stamp and is supported by a buffer spring on the machine frame. The spring characteristic and/or preloading of the buffer spring, which is located between the buffer and machine frame, and of the spring which effects the leading positioning of the stamp relative to the press carriage, are coordinated with each other in such a manner that, upon engagement or grasping of a wire segment by the stamp and the matrix, the spring force of the spring which effects the leading positioning of the stamp prevails over or exceeds the spring force of the buffer spring which supports the buffer, while in the course of further movement of the stamp in the pressing direction, the spring force of the buffer spring prevails over or exceeds the spring force of the spring which effects the leading positioning of the stamp.

15 Claims, 12 Drawing Figures

FIG. 11
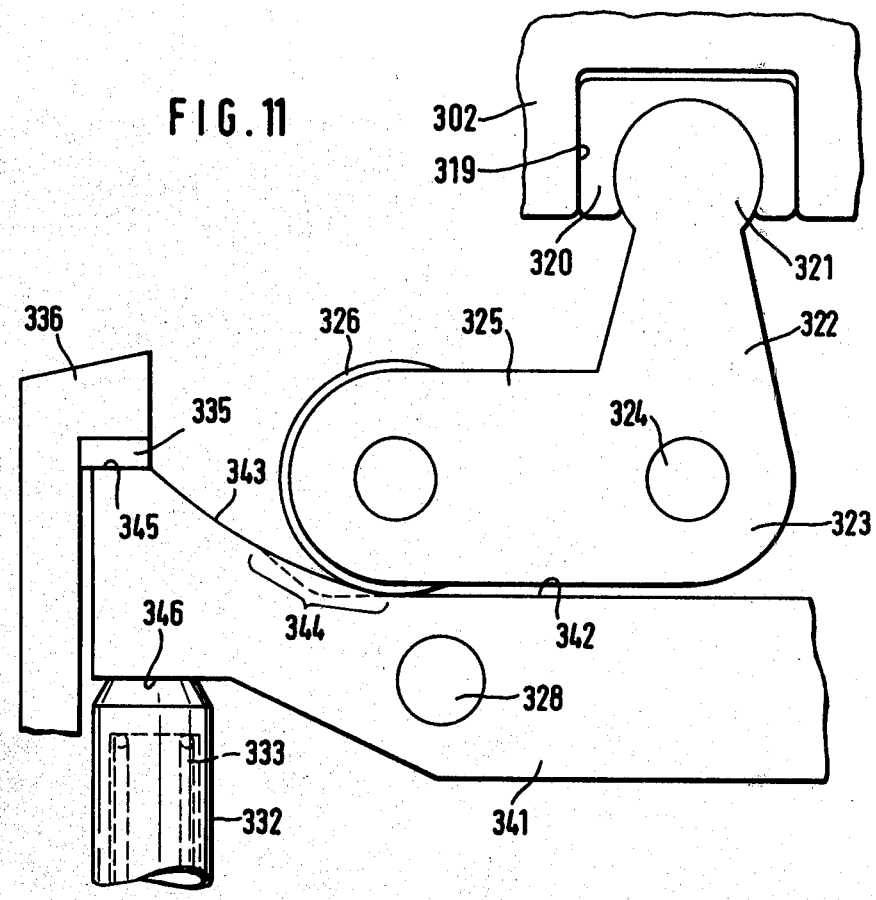
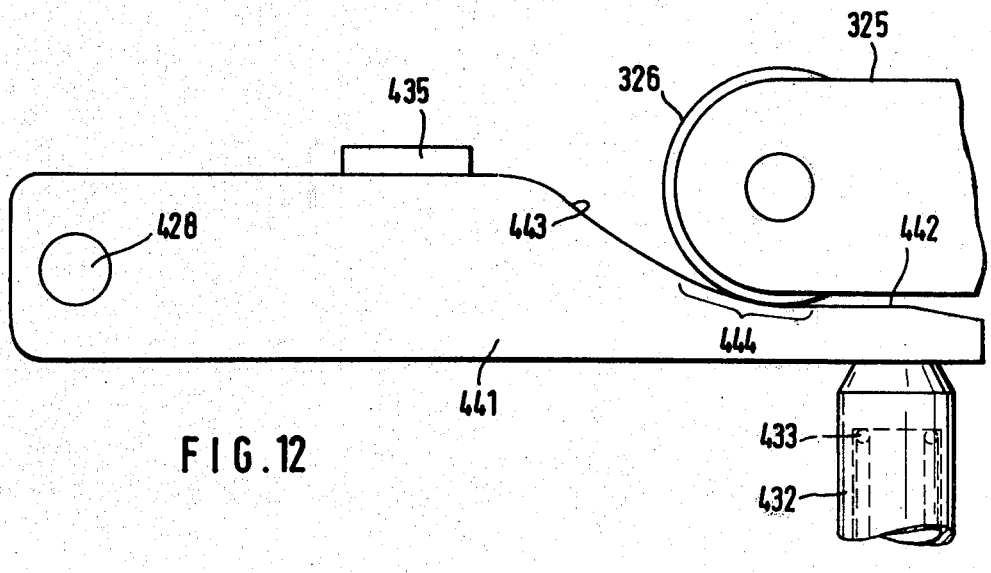
FIG. 12

PRESS FOR PRODUCING WORKPIECES FROM WIRE SEGMENTS

BACKGROUND

The present invention relates to a press for producing workpieces such as spherical bodies, balls, and the like from wire clippings or segments. The press includes a stationary matrix, a press carriage drivable back and forth, a crankshaft drive for the press carriage, a leading stamp drivably connected with the press carriage, a spring effecting the leading of the stamp relative to the press carriage, and finally with a supply or feed device for wire segments. Such a press with a leading stamp is described for instance in U.S. Pat. No. 165,424.

Particularly with presses of the mentioned type, which are employed for producing balls or similar workpieces from relatively short wire segments, there has previously existed the possibility that the leading stamp strikes or impinges the feeder for the wire segments still located in the space between the stamp and the matrix if for some reason no wire segment was conveyed between the stamp and the matrix. A considerable damaging or even destruction of parts of the stamp and/or of the feeder can result herefrom.

OBJECT

It is an object of the present invention to preclude a damaging of parts of the tools, or of the feeder for the wire segments, in the event no wire segment, or only a wire segment which is too short, is conveyed by the feeder between the two tools, i.e. between the matrix and the stamp, where it is normally kept ready for engagement by the tools.

DRAWING

This object, and other objects and advantages of the present invention, will appear more clearly from the following specification in connection with the accompanying drawings, in which:

FIG. 11 shows a cutaway portion of the press corresponding to the embodiment of FIG. 8, and more particularly shows the region of the lever and coulisse, rocker arm, or crank; and FIG. 12 shows a further embodiment with a crank mounted at a different location.

SUMMARY

Figure 1:
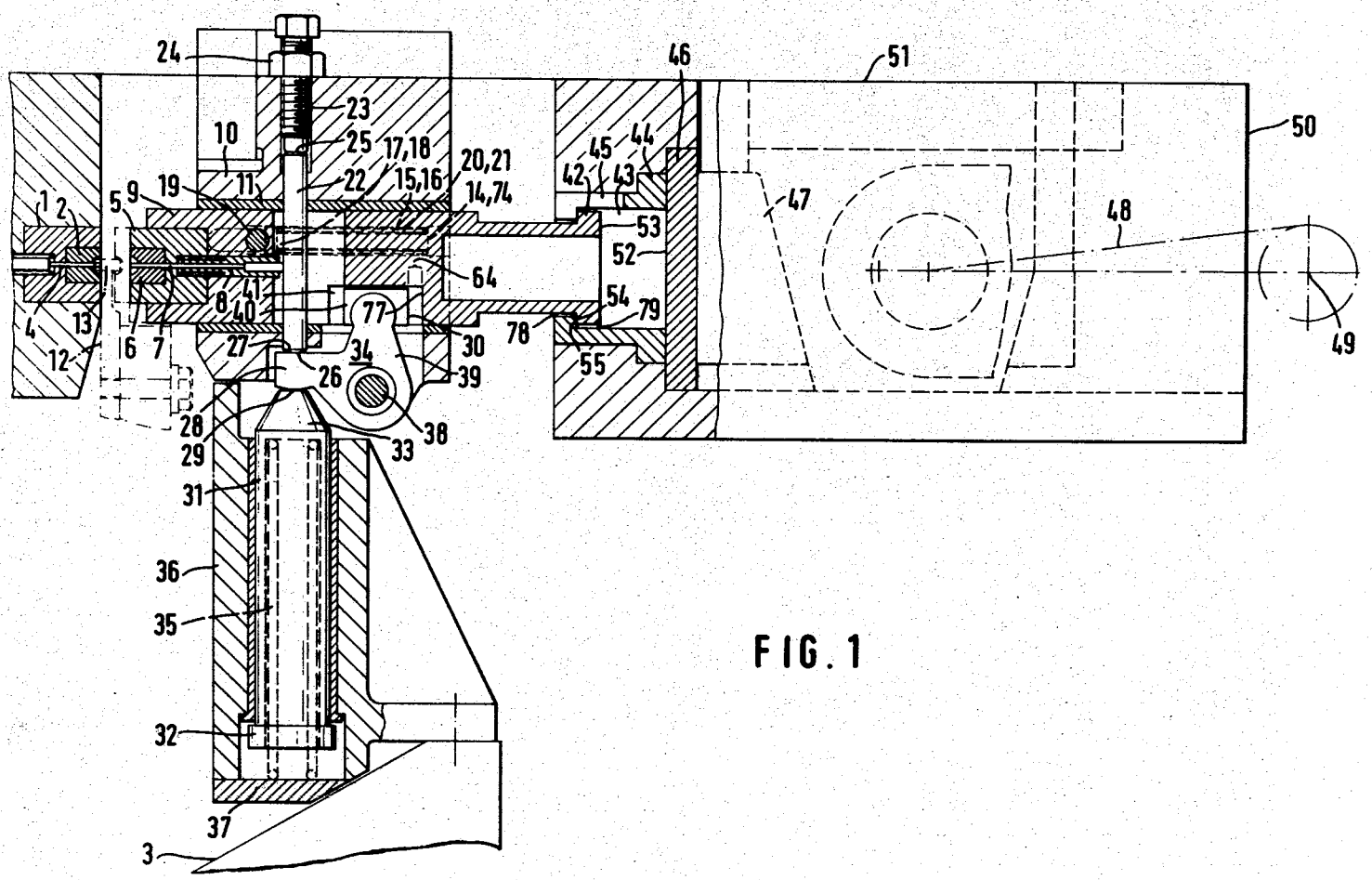
FIG. 1 shows a side view of a preferred embodiment of a press in accordance with the present invention.

The press of the present invention is characterized primarily in that a buffer is associated with the stamp and is resiliently yieldable in the pressing direction, with the buffer being supported by a buffer spring on the machine frame, and in that the spring characteristic and/or preloading of the buffer spring, which is located between the buffer and the machine frame, and of the spring which effects the leading positioning of the stamp relative to the press carriage, are coordinated with each other in such a way that, upon engaging or grasping of a wire segment by the stamp and the matrix, the spring force of the spring which effects the leading positioning of the stamp prevails over the spring force of the buffer spring which supports the buffer, while in the course of further movement of the stamp in the pressing or stamping direction, the spring force of the buffer spring prevails over the spring force of the spring which effects the leading positioning of the stamp.

ADVANTAGES

During pressing with a leading stamp, there is attained by way of the present inventive improvement that the feeder or supplier for the wire segments can be moved, free of disturbance and without the danger of any damage or destruction, from the space between the stamp and the matrix even if for some reason no wire segment, or a wire segment which is too short, has been conveyed by the feeder. Here, as was the case with the known presses having leading stamping or forging means, a wire segment of correct length located between the stamp and the matrix would effect a holding back of the stamp relative to the pressing carriage over a certain portion of the pressing stroke.

In a preferred embodiment of the present invention, the buffer is formed by a lever which is associated with a work or effective surface located on the stamp holder.

In accordance with the foregoing, special arrangements and features are also possible. For instance, the lever may be journalled stationarily, though it is also possible that the lever be journalled on the press carriage.

According to a further embodiment, a coulisse, crank, or rocker arm, which is mounted on the machine frame, is associated with a lever journalled on the press carriage. This coulisse or rocker arm can be resiliently yieldably journalled on the machine frame, for instance linearly movable transverse to the pressing direction. In a preferred embodiment, the coulisse is pivotally journalled on the machine frame, while the buffer spring is supported on the one hand against the coulisse or rocker arm, and on the other hand against the machine frame.

In a further embodiment, with a rocker arm mounted on the machine frame, and a lever journalled on the press carriage, the lever is made in two parts, and a stationary coulisse or rocker arm is associated with the ends of the one or the other lever, which ends are located across from each other and are under the effect of the buffer spring.

An embodiment of the press which can be realized with relatively little cost is characterized in that the buffer with the buffer spring is arranged in the space between the stamp, or stamp holder, and the matrix, or in a region of the machine frame adjoining the matrix. Accordingly, such a buffer can, for instance, comprise one or more pin-like structural elements which are resiliently yieldable in the direction of the longitudinal axis, and are made, for example, of a suitable rubber material. These structural elements engage in corresponding bores in a region of the machine frame or matrix located across from the stamp.

Depending upon the selective structural solution for the press, and also upon the size of the workpieces to be made, it is expedient with a corresponding size of stamp and stamp holder, that the stamp be fastened in a stamp holder which is shiftably guided in the pressing direction in a stationary support. In this manner, the press carriage can be relieved of the relatively great weight of the leading stamp, which has the stamp holder. The stamp holder may be mounted on the machine frame so as to be releasable from the drive connection with the press carriage transverse to the pressing direction.

It is also advantageous if means such as an adjusting pin are provided for setting or adjusting the buffer, i.e. for adjusting the time point of engagement of the stamp or stamp holder and buffer in the course of a stroke of the press carriage in the pressing direction.

According to another embodiment of the present invention, with a rocker arm mounted on the machine frame and a lever pivotally journalled on the press carriage and provided with a roller, the rocker arm may be provided with two adjoining running or rolling surfaces for the roller of the lever, with one of the running surfaces extending in the pressing direction, and the other running surface extending at an angle thereto as to rise or increase in the pressing direction.

During operation of the press as described above, it has been shown that in the course of the forward movement of the press carriage there is introduced a relatively high force impact of the rocker arm by way of the roller into the lever for the buffering of the stamp holder when the roller passes from the running surface extending in the pressing direction onto the adjoining slightly rising running surface. This is true in the situation illustrated according to FIG. 8 when no wire segment is kept ready between the stamp and the matrix. Otherwise with this embodiment the roller previously would lift from the running surface and thereupon would not or at first would not come into contact with the rising running surface. The same is true for variations of this embodiment.

For the purpose of avoiding or at least to a great extent reducing the mentioned force impacts, it is inventively proposed that a transition running or rolling surface be provided which connects the two running surfaces of the rocker arm with one another; the transition running surface has a curvature which is less than the curvature of the rolling surface of the roller of the lever. With this feature, there is effected during the course of the forward movement of the press carriage a gradual rising or increase of the force introduced into the lever from the running surfaces of the coulisse by way of the roller. Considerable force impacts or force peaks, which are far greater than the convention level of forces arising at this location, are hereby avoided, which advantageously results in a long, disturbance-free operation of the press.

In a further development of this concept of the present invention, it is additionally proposed, with a rocker arm which is pivotally and resiliently yieldably mounted in the machine frame, that the rotational axis of the coulisse lie in a region of the coulisse remote from the rear dead center position of the press carriage. Hereby there is attained that the effect of the buffer spring which engages the coulisse is at first relatively small in the course of forward movement of the press carriage toward the matrix, while this effect gradually increases during further forward movement of the press carriage or of the lever under the influence of the continuously changing lever transmission or leverage. Accordingly, the desired and advantageous effect of the aforementioned transition running surface is still further enhanced with such an embodiment of the mounting of the coulisse.

DETAILED DESCRIPTION

Figure 2:
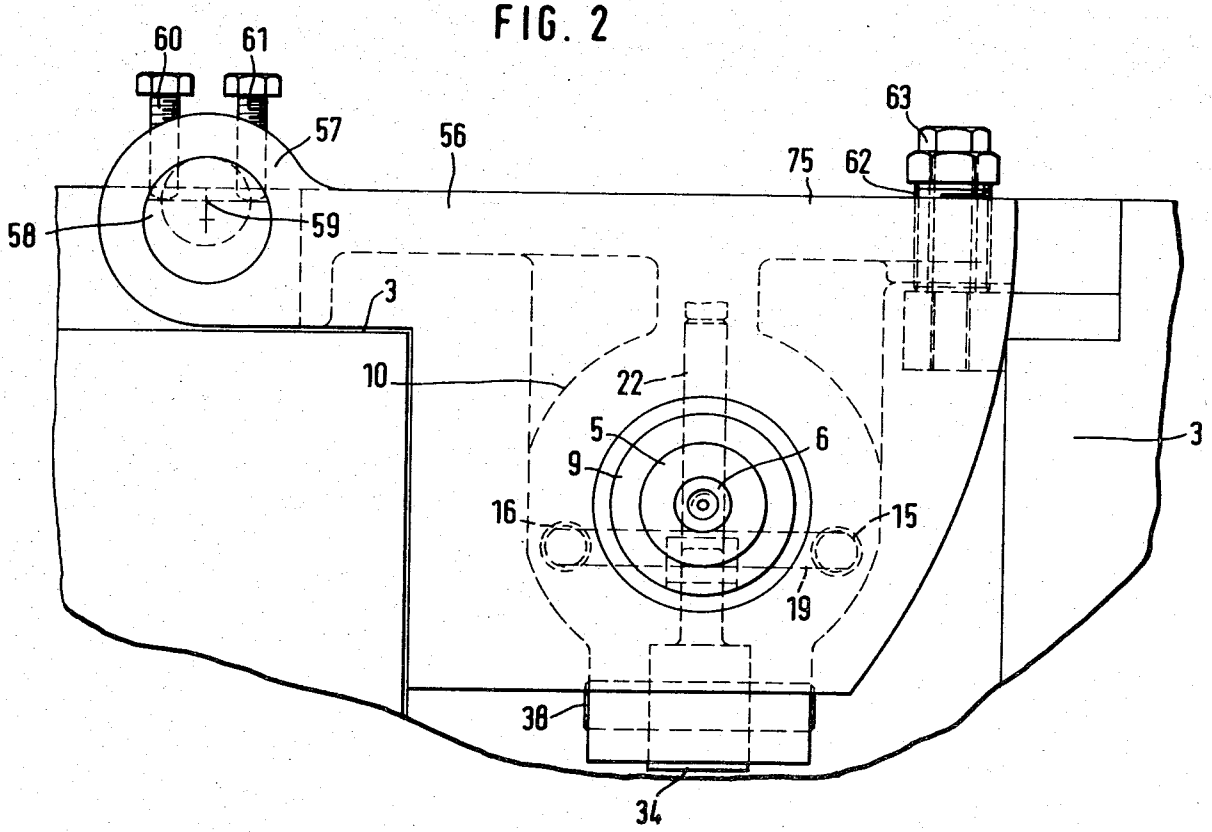
FIG. 2 is a front view of a portion of the press of FIG. 1.

Referring now to the drawings in detail, FIGS. 1 and 2 of the drawings show parts of a press in accordance with the present invention, although only to the extent necessary for describing the invention.

FIG. 1 shows a matrix 1 which has a matrix insert 2 and is fastened in a stationary machine frame 3. For the purpose of producing balls, the matrix insert 2 has a spherical recess. A controllable eject needle or pin 4 is provided for the purpose of ejecting finished pressed or stamped workpieces.

A stamp or press 5 is arranged in a stamp holder 9 across from the matrix 1. The stamp 5 includes a stamp insert 6, which likewise has a spherical recess.

An eject needle of pin 7 for ejecting finished pressed workpieces (balls or spheres) is also associated with the stamp 5 having the stamp insert 6. That end of the eject pin remote from the stamp 5 is guided in a spring-loaded or spring-biased sleeve 8.

The stamp holder 9 is mounted in a support 10 in such a way as to be shiftable in the pressing or stamping direction. A sleeve 11 is additionally provided between the support 10 and the stamp holder 9. A feeder or supplier 12 for wire scrap or segments 13 is illustrated by dash lines and is located in the space between the matrix 1 and the stamp 5. That end of the illustrated wire segment 13 remote from the matrix engages wall parts of the spherical recess of the stamp holder 6, which, together with the stamp 5, is drawn in this position by dash lines. The other end of the wire segment 13 engages wall parts of the spherical recess of the matrix insert 2. The support 10 has stationary abutments 14, 74 for pressure or compression springs 15 and 16 which effect the leading positioning of the stamp 5 relative to the press carriage 50. The other ends of the springs 15 and 16 rest on spring guide bolts 17 and 18 which engage a transverse bolt 19. The transverse bolt 19 is fastened in the stamp holder 9. The compression springs 15 and 16 are located in bores 20 and 21 of the support 10.

An adjustment pin 22 is adjustably guided in the support 10 in a plane extending transverse to the press direction. The adjustment pin 22 is adjustable by means of the setscrew or adjusting screw 23 and the lock nut 24, and serves as an abutment for delimiting the effective range of a buffer spring 35. The end 25 of the adjustment pin 22 engages an associated end of the adjustment screw 23, while the end 26 of the adjustment pin 22 engages side 27 of the arm 28 of a dual-arm lever 34. The other side 29 of the arm 28 of the lever 34 engages the head 33 of a sleeve 31 which is guided so as to be longitudinally shiftable in a stationary bearing or support 36, and has a collar 32 at that end remote from the head 33. The buffer springs 35 is guided in the sleeve 31 and on the one hand is supported in the sleeve 31 in the region of the head 33 thereof, and on the other hand is supported against a bottom 37 of the support 36.

The lever 34 is pivotally journalled on a stationary shaft 38. The free end of the other arm 39 of the lever 34 supports a sliding block 40 in a somewhat movable manner on a nearly circular or annular extension. The sliding block 40 is located within a recess 41 of the stamp holder 9, and forms a buffer 30 for the stamp holder 9 and stamp 5, which lead or advance under the influence of the compression springs 15 and 16.

The stamp holder 9 terminates in a flange-like extension 42 on that side remote from the stamp 5. This extension 42 is located within a hollow chamber 43 of a driving sleeve 44. The driving sleeve 44 is fastened on a plate 46 of the press carriage 50 or, while firmly engaging thereagainst, is connected with the remaining parts of the press carriage 50. The driving sleeve 44 additionally has a slot or a recess 45 which extends approximately over half the periphery of the driving sleeve 44, and makes possible a pivoting-out of the stamp holder 9 which the extension 42 from the hollow chamber 43 of the driving sleeve 44.

An adjustment wedge 47 engages that side of the plate 46 remote from the driving sleeve 44; this adjustment wedge 47 is also supported on parts of the press carriage 50. The driving sleeve 44 is drivably connected by the plate 46 and the adjustment wedge 47 with a connecting rod 48, which also engages a crankshaft having an axis of rotation 49. The press carriage 50 is closed off by means of cover 51.

A pressure or bearing surface 52 of the plate 46 is located across from a bearing or pressure surface 53 of the extension 42 of the stamp holder 9. Furthermore, an engagement or abutment surface 55 of the extension 42 of the stamp holder 9 is located across from an abutment surface 54 of the driving sleeve 44.

FIG. 2 shows that the support 10 has an arm 56 which terminates in a support collar 57. The support collar 57 surrounds an eccentric 58 having a stationary axis of rotation 59. Adjustment or setscrews 60 and 61 in the support collar 57 serve for adjusting the eccentric 58 in one direction or another. Furthermore, the support 10, on the other side, has an arm 75 which carries an adjustment nut 62 with an arresting screw 63. The arresting screw 63 engages in a threaded bore of the machine frame 3, while the adjustment nut 62 is supported upon a surface or support of the machine frame 3. The adjustment screws 60 and 61, as well as the adjustment nut 62 with the arresting screw 63, serve for adjusting the stamp holder 9 with the stamp 5 in a plane located transverse to the press direction. Intermediate spaces or gaps 78 and 79 between the driving sleeve 44 and the extension 42 permit such an adjustment to a certain extent.

The manner of operation of the press of FIGS. 1 and 2 is set forth in detail in the following paragraphs.

FIG. 1 shows the press in the rear dead center position of the press carriage 50. While the press carriage 50 is located in the rear dead center location, the movement of the feeder 12 for the purpose of transporting a wire segment 13 into the space between the matrix 1 and the stamp 5 is nearly completed. During the start of the stroke of the press carriage 50, namely at 25° stroke in the diagram of FIG. 3, the feeder 12 remains in that position which makes possible an engaging or grasping of the pertaining wire segment 13 by the stamp 5 and the matrix 1 (see point 72 in FIG. 3). During further movement of the press carriage 50 in the direction toward the matrix 1, the spherical recesses of the stamp 5 and the matrix 1 begin to surround and grasp or hold the pertaining wire segment 13 as represented by point 65 of the diagram of FIG. 3 (curve path for the stamp holder 9). Shortly thereafter, namely at the location of point 69 in FIG. 3, the return movement of the feeder 12 begins from the space between the stamp 5 and matrix 1 (curve path for the feeder 12), and terminates at the location of point 70 in FIG. 3.

Figure 3:
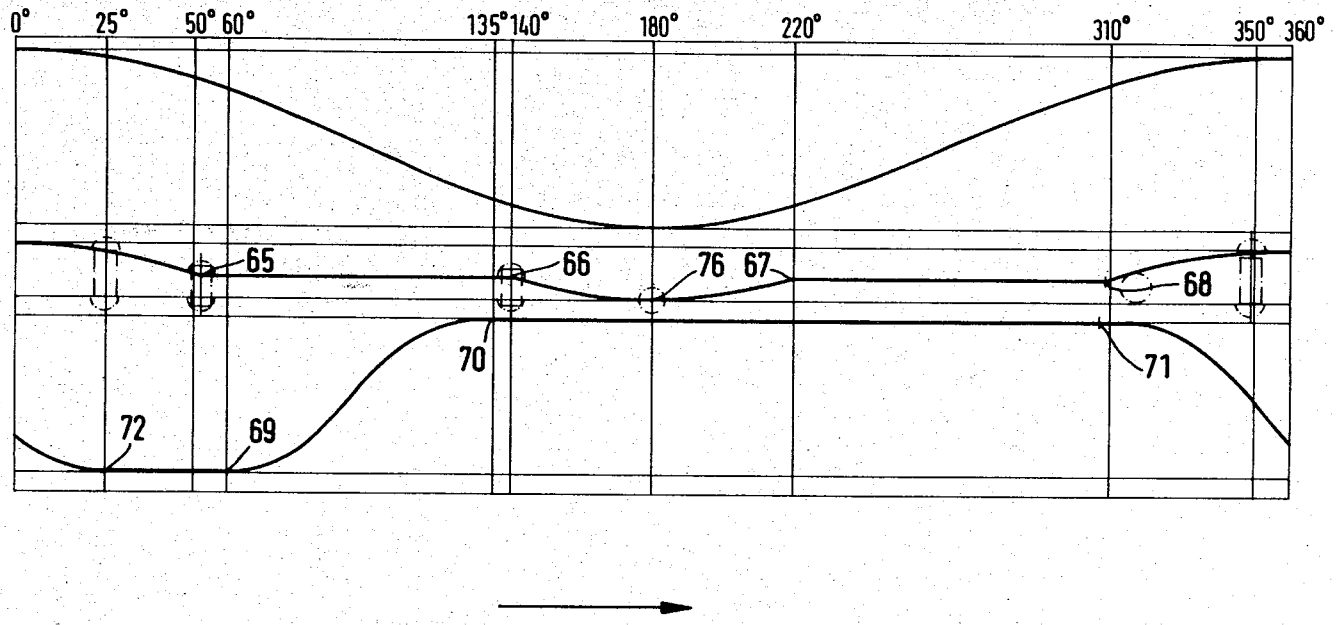
FIG. 3 is a diagram setting forth functional progress of different structural parts of the press of FIG. 1.

From point 65 in FIG. 3, the stamp holder 9 moves relative to the press carriage 50 or the driving sleeve 44, since the wire segment 13 grasped between the stamp 5 and the matrix 1 initially precludes a further movement of the stamp 5 or the stamp holder 9 toward the matrix 1. Up to this point in time the abutment surfaces 54 and 55 of the driving sleeve 44 and the extendsion 42 have engaged each other under the force or effect of the compression springs 15 and 16.

The intermediate space existing at the time of grasping of a wire segment 13 between the stamp 5 and the matrix 1, which intermediate space is located between the pressure surfaces 52 and 53 of the press carriage 50 and the stamp holder 9, causes a longer standstill of the stamp holder 9 relative to the matrix 1, so that a frictionless return movement of the feeder 12 is made possible. The pressure surfaces 52 and 53 first engage each other at the location represented by point 66 in FIG. 3, so that beyond this point 66 the pressing or stamping procedure begins. The pressing procedure terminates at a location represented by the point 76 in FIG. 3, which corresponds to the front dead center position of the press carriage 50.

With the movement of the stamp holder 9 toward the matrix 1, the surface 77 of the recess 41 of the stamp holder 9 comes increasingly closer to the buffer 30, so that accordingly the distance 64 between the surface 77 and the buffer 30 is reduced. The adjustment pin 22 is adjusted by means of the adjustment screw 23 in such a way that in the event a wire segment 13 of correct length is present between the stamp 5 and the matrix 1, a relatively small spacing, for example in a magnitude of a few tenths of a millimeter, still exists between the surface 77 of the stamp holder 9 and the buffer 30. As soon as the pressure surfaces 52 and 53 come into driving contact with each other in the course of a stroke, first the aforementioned small spacing between the surface 77 of the stamp holder 9 and the buffer 30 is overcome, whereupon as the pressing process continues, the buffer spring 35 is then stressed by the arm 28 of the lever 34, and by the sleeve 31.

After termination of the pressing procedure and beginning of the return movement of the press carriage 50, the pressure surface 53 of the stamp holder 9 is at first held in contact with the pressure surface 52 of the press carriage 50 under the influence of the buffer spring 35 by way of the buffer 30 and the surface 77 of the stamp holder 9. However, as soon as in the course of the corresponding pivot movement of the lever 34 the side 27 of the arm 28 of tthe lever 34 engages the end 26 of the adjustment pin 22, a further return movement of the stamp holder 9 under the influence of the pressure or compression springs 15 and 16 is stopped, so that the pressure surfaces 52 and 53 separate from each other, and the abutment surfaces 54 and 55 move toward each other. During this relative movement between the extension 42 of the stamp holder 9 and the driving sleeve 44 of the press carriage 50, the surface 77 of the stamp holder 9 engages the buffer 30 under the influence of the compression springs 15 and 16. The beginning of this period is designated with point 67 in FIG. 3. Only when it has reached the point 68 in FIG. 3 has the press carriage 50 moved back so far that the abutment surfaces 54 and 55 are again in driving contact with each other. Thus, only in the last part of the return movement of the press carriage 50 does there occur a following or taking along of the stamp holder 9 counter to the force of the compression springs 15 and 16 by the press carriage 50. Therefore, only after reaching approximately point 71 in FIG. 3 is there introduced a renewed feeder or supply movement of the feeder 12, since only upon reaching the time point designated by point 68 in FIG. 3 has there been created sufficient space between stamp 5 and matrix 1 for introducing a further wire segment 13. This feed or supply movement in the location designated by point 72 in FIG. 3.

In the event that for some reason the feeder 12 has not conveyed a wire segment between the stamp 5 and the matrix 1, or is not holding a wire segment ready at this location for engagement or grasping by both tools, the surface 77 of the stamp holder 9 in the course of the associated pressing stroke runs up on the buffer 30. The force of the compression springs 15 and 16 which effect the leading positioning of the stamp 5 or the stamp holder 9, at least at the time point of running of the surface 77 upon the buffer 30, is less than the force of the buffer spring 35, so that the stamp holder 9 at first is held in the respective position defined by the buffer 30, and so that a frictionless return movement of the feeder 12 is made possible. A further relative movement of the stamp holder 9 toward the matrix 1, accompanied by overcoming the buffer spring 35, occurs only when the pressure surfaces 52 and 53 have come into driving contact with each other.

The buffer 30 with the buffer spring 35 consequently precludes an otherwise possible damaging or even destruction of the feeder 12 and/or tools 1 and 5 (matrix 1 and stamp 5) in the event an appropriate length of wire segment 13 is not present between the stamp 5 and the matrix 1.

Figure 4:
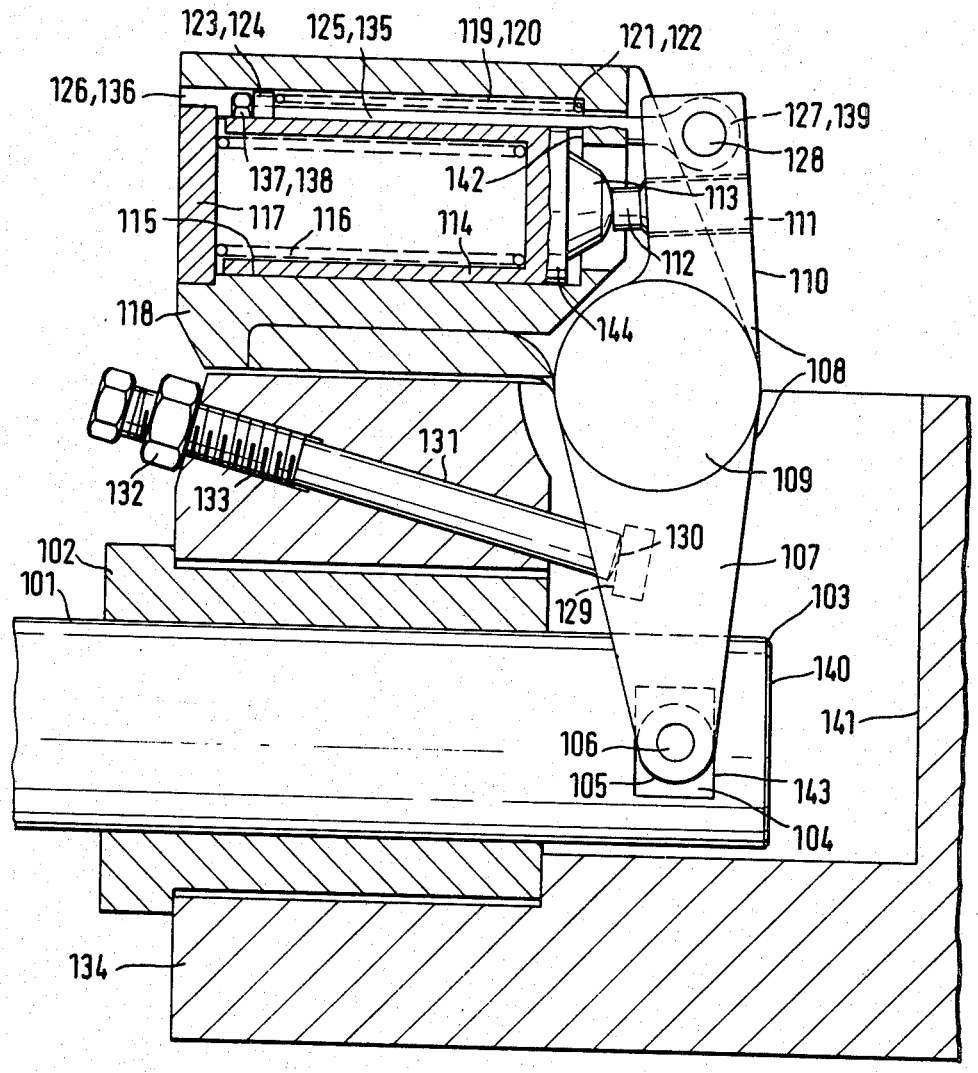
FIG. 4 is a side view of another embodiment of a press in accordance with the present invention.
Figure 5:
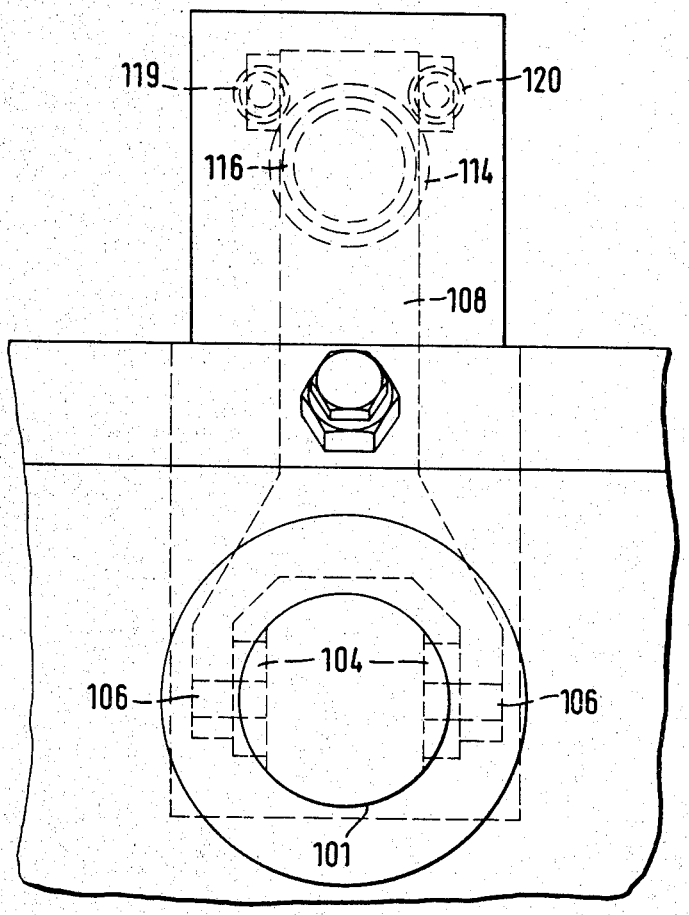
FIG. 5 is a front view of a portion of the press illustrated in FIG. 4.

The embodiment of the inventive press according to FIGS. 4 and 5 has a stamp holder 101 which is mounted in a support 102. The support 102 is fastened on a press carriage 134. Guide grooves 104, in which rollers 105 run which are journalled upon bolts or pins 106, are located in the region of the end 103 of the stamp holder 101. The bolts 106 are fastened in oppositely located ends of one arm 107 of a lever 108. The lever 108 is pivotally journalled about a stationary shaft 109 in a machine frame.

The other arm 110 of the lever 108 carries a pressure screw 111 adjustably mounted therein. The end 112 of the pressure screw 111 engages an extension 113 of a sleeve 114, which is journalled so as to be shiftable approximately in the pressing direction in a bore 115 of a stationary receiving support 118. Within the sleeve 114 is located a pressure spring 116 which is supported on the one hand against the sleeve 114 and on the other hand against a bottom 117 of the receiving support 118.

Furthermore supported in the receiving support 118 are buffer springs 119 and 120, one end of which engages abutments 121 or 122, and the other end of which engages an abutment or engagement ring 123 or 124. A drawbar or pull rod 125 or 135 passes through the buffer springs 119 and 120. This pull rod has a follower (screw nut) 137 or 138 at the end 126 or 136, and at the other end terminates in a hub or collar 127 or 139. A bolt 128 passes through the collars 127 and 139 and is fastened in the arm 110 of the lever 108.

An abutment 129 for a setscrew 131 is provided on the arm 107 of the lever 108. The setscrew 131 is arrestable in a selected position by means of a lock nut 132. The setscrew 131 is screwed into a threaded bore 133 of the press carriage 134.

The manner of operation of the press of FIGS. 4 and 5 is described in the following paragraphs.

FIG. 4 shows the press in the rear dead center position of the press carriage 134. Accordingly, the pressure surface 141 of the press carriage 134 is separated to the greatest possible extent from the pressure surface 140 of the stamp holder 101. Consequently, the end 130 of the setscrew 131 engages the stop or abutment 129 of the lever 108. The lever 108 is consequently held in one position, i.e. under the influence or effect of the setscrew 131 fastened on the press carriage 134, in which position the setscrew 111 further compresses the pressure spring 116 by way of the end 112 of the setscrew 111 and the extension 113 of the sleeve 114. The buffer springs 119 and 120 are consequently slightly relieved. During beginning movement of the press carriage 134 in a direction toward the non-illustrated matrix or the wire to be kept ready, there occurs first the following of the movement of the press carriage 134 by the stamp holder 101 under the influence of the pressure spring 116, and in particular as long as the pressure spring 116 can maintain driving contact between the abutment 129 of the lever 108 and the setscrew 131 by way of the sleeve 114 and the setscrew 111. The force of the pressure spring 116 prevails under these circumstances compared with the force of the oppositely effective buffer springs 119 and 120. If a wire segment of the correct length is kept ready between the stamp and the matrix, the sequential movement of the stamp holder 101 is interrupted if there still exists a certain spacing between the head part 144 of the sleeve 114, and an abutment 142. While the pressure surfaces 140 and 141 of the stamp holder 101 and the press carriage 134 comes closer to each other, the stamp holder 101 and the lever 108 do not move. The end 130 of the setscrew 131 therefore withdraws from the abutment 129. As soon as the pressure surfaces 140 and 141 come into driving contact with each other, the associated wire segment is reformed or changed in form. The lever 108 is swung or pivoted further during the actual pressing procedure, so that the head part 144 engages the abutment 142, and the setscrew 111 separates from the sleeve 114. Consequently, the buffer springs 119 and 120 are further tensioned.

After successful reforming of the associated wire segment, the stamp holder 101, during return of the press carriage 134 under the influence of the buffer springs 119 and 120, engages with its pressure surfaces 140 against the pressure surfaces 141 of the press carriage 134, and the stamp holder 101 accordingly follows the press carriage 134, until the setscrew 111 again engages the sleeve 114. In the further course of the return stroke of the press carriage 134, the end 130 of the setscrew 131 approaches the abutment 129 of the lever 108, which in the mean time stands still together with the stamp holder 101. Not until near the end of the return stroke of the press carriage 134 does the end 130 of the setscrew 131 engage the abutment 129 of the lever 108, so that the lever 108, in the last part of the return stroke of the press carriage 134, is swung or pivoted further under tension of the pressure spring 116, and accordingly the head part 144 of the sleeve 114 releases from the abutment 142. Moreover, it is of course to be understood that also with this embodiment of the inventive press, as with all further embodiments, there exists the functional sequence characterized by the diagram in FIG. 3, which features the symmetrical sequence of back and forth movements of the individual functional groups.

In the event, however, that no wire segment or wire segment with the correct length is kept ready between the stamp and the matrix, the stamp holder 101, in the course of the feed or advance movement of the press carriage 134, moves further toward the matrix by a nominal amount until the head part 144 of the sleeve 114 engages the abutment 142. In this position, the stamp holder 101 is held by the force of the buffer springs 119 and 120 until the pressure surfaces 140 and 141 come into driving contact with each other. The subsequent functional sequence has already been explained.

Figure 6:
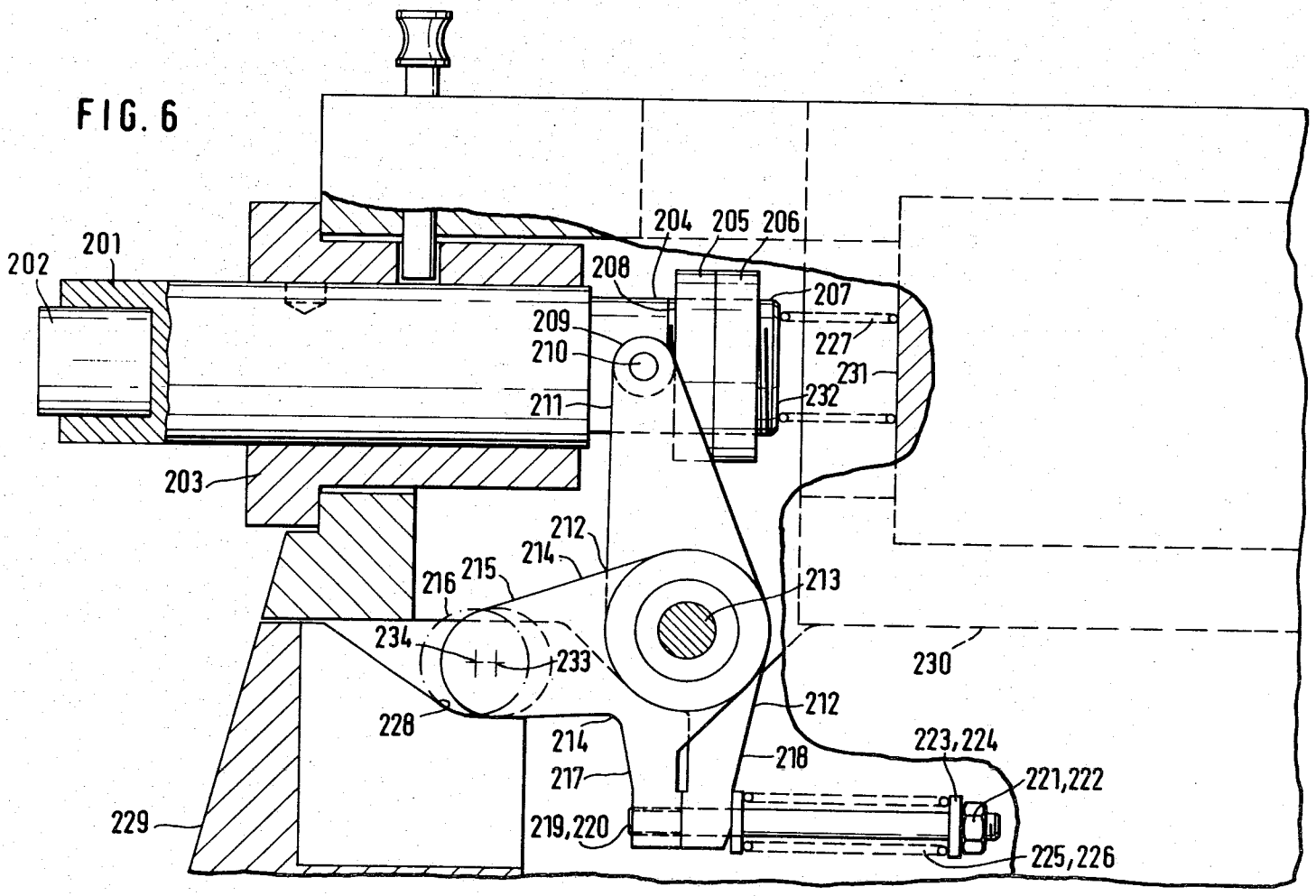
FIG. 6 shows a side view of a third embodiment of a press having features in accordance with the present invention.
Figure 7:
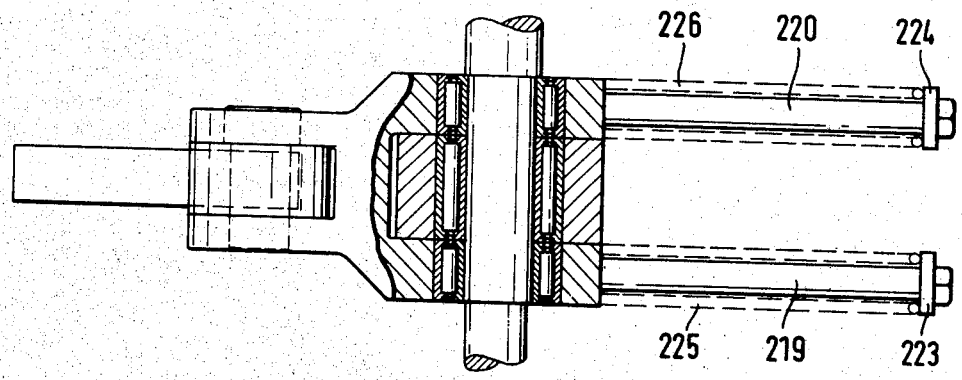
FIG. 7 is a plan view of a portion of the press illustrated in FIG. 6.

A third embodiment of the inventive press is shown by FIGS. 6 and 7 of the drawings.

FIG. 6 shows a stamp holder 201 which carries a stamp 202. The stamp holder 201 with stamp 202 is shiftably guided in a bearing or support 203. The support 203 is fastened on a press carriage 230. The end 204 of the stamp holder 201 has annular nuts 205 and 206 which are adjustably journalled on a thread 207 of the stamp holder 201. The annular nut 205 has a work or effective surface 208 along which the roller 209 passes. The roller 209 is rotatably journalled upon a bolt 210 which is fastened in an arm 211 of the lever 212. The lever 212 is pivotally journalled on a shaft 213. The shaft 213 is fastened on the support 203 or in the press carriage 230. Aside from the lever 212, a further lever 214 is pivotally journalled on the shaft 213. An arm 215 of the lever 214 carries a roller 216. The other arm 217 of the two-arm lever 214 engages an arm 218 of the likewise two-arm lever 212 under the influence of buffer springs 225 or 226. One end of the screw bolt 219 or 220 is fastened for this purpose in the arm 217 of the lever 214, and the other ends of the screw bolts 219 or 220 carry a screw nut 221 or 222. A ring or washer 223 or 224, which is under the effect of the force of the buffer springs 225 or 226, is supported on the screw nuts 221 and 22. The screw bolts 219 and 220 passes through a recess in the free end of the arm 218 of the lever 212.

A pressure spring 227 is arranged between a pressure surface 231 of the press carriage 230, and a pressure surface 232 of the stamp holder 201 across from the pressure surface 231. Associated with the roller 216 of the lever 214 is a crank or rocker arm 228 fastened in the machine frame 229.

The manner of operation of the press according to FIG. 6 is as follows:

FIG. 6 shows the press in the rear dead center position of the press carriage 230. The geometric axis of rotation of the roller 216 is accordingly located at the position 233. Consequently, the roller 216, under the effect of the pressure spring 227, engages a part of the coulisse or rocker arm 228 which extends in the pressing direction or approximately in the pressing direction. During the starting movement of the press carriage 230 in a direction toward the non-illustrated matrix, the stamp holder 201, in conformity with the path of the associated part of the coulisse or rocker arm 228 extending in pressing direction and under the influence of the pressure spring 227, likewise moves in a direction toward the matrix. If under these circumstances the stamp 202 engages an appropriately provided wire segment of correct length, the stamp holder 201 is kept relatively immovable relative to the matrix so long by way of the wire segment grasped and held between the stamp 202 and the matrix until the pressure surfaces 231 and 232 come into driving contact with each other and the actual pressing or stamping procedure is carried out. From the time point of engaging or grapsing of a wire segment until the beginning of the pressing procedure, the geometric axis of rotation of the bolt 210 therefore remains practically unmoved relative to the machine frame 229, while the geometric axis of rotation (shaft 213) of the lever 212 and 214 moves toward the matrix with the speed of the press carriage 230. Under these circumstances the roller 216 of the lever 214 rises or lifts slightly from the path of the coulisse or rocker arm 228 and, while maintining the mentioned nominal spacing as to the path of the coulisse or rocker arm 228, begins to move upward approximately parallel to the rising part of the path in conformity with the advancing stroke of the press carriage.

As soon as the pressure surfaces 231 and 232 cone into engagement with each other in the course of the further forward movement of the press carriage, and as soon as the pressing procedure or operation begins, the bolts 210, together with the stamp holder 201, is moved in a direction toward the matrix over the surface 208 of the annular nut 205, so that the roller 216, under the tension of the buffer springs 225 and 226, engages the coulisse or rocker arm 228, and consequently the arms 217 and 218 of the levers 212 and 214 separate from each other.

In the event that between the stamp 202 and the matrix no suitable wire segment is appropriately provided, the stamp holder 201 in any case remains so long in a position making possible the frictionless return movement of the feeder for the wire segments until the pressure surfaces 231 and 232 come into engagement with each other, and accordingly driving contact exists between the press carriage 230 and the stamp holder 201. This is attained thereby that by way of the coulisse or rocker arm 228 and roller 216 of the lever 214, the lever 212, after overcoming the mentioned nominal spacing between the roller 216 and coulisse or rocker arm 228, is moved in such a manner that the axis of the bolt 210, for the mentioned time period, stands still relative to the machine frame until driving contact exists between the pressure surfaces 231 and 232, in spite of the shaft 213, which moves with the press carriage and serves as a support for the levers 212 and 214.

Figure 8:
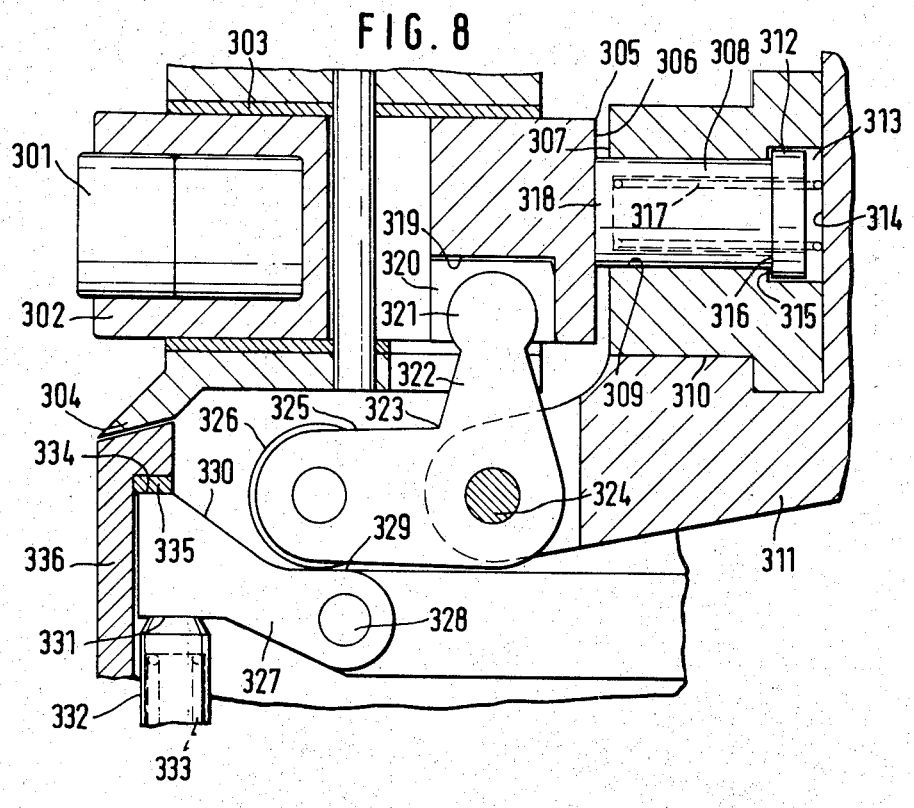
FIG. 8 is a side view of a fourth embodiment of a press having features in accordance with the present invention.

The press of FIG. 8 can be considered as a combination of the press of FIG. 6 with features of the press of FIG. 1. The press has a stamp 301 which is fastened in a stamp holder 302. The stamp holder 302 is guided so as to be longitudinally shiftable in a sleeve 303, which is fastened in a stationary support 304. The end 305 of the stamp holder 302 has a pressure surface 306 which is located across from a pressure surface 307 of an insert 310 of a press carriage 311. A sleeve 308 is axially shiftably guided in a bore 309 in the insert 310. The insert 310 is fastened on the press carriage 311. The sleeve 308 has a collar 312 which is located inside a recess 313 between the surfaces 314 and 315 of the insert 310. A predetermined spacing still exists as indicated in the rear dead center position of the press carriage between the surface 315 and a surface 316 of the collar 312. A pressure spring 317 is located in the sleeve 308. This pressure spring on the one hand is supported on the bottm 318 of the sleeve 308, and on the other hand on the surface 314 of the part 311.

A sliding block 320 is guided practically free of play in a recess 319 located in the stamp holder 302; the sliding block 320 is journalled on the head part 321 of the arm 322 of a lever 323 in such a way as to be rotatably movable to a certain extent. The lever 323 is pivotally journalled on a shaft 324 which is fastened on the press carriage 311.

One arm 325 of the lever 323 carries a roller 326 which is associated with a crank or rocker arm 327. The rocker arm 327 is pivotally journalled on a shaft 328 fastened in the machine frame 336. The rocker arm 327 has a running surface 329 extending in the direction of movement of the press carriage 311, and also includes an adjoining running surface 330 inclined relative thereto for the roller 326. Furthermore, the crank or rocker arm 327 has a stop 331 upon which a sleeve 332 engages under the influence of the buffer spring 333, which is supported upon a non-illustrated location on the machine frame. A stop 334 of the rocker arm 327 is located across from the stop 331, and this stop 334 engages against a stationary abutment 335 of the machine frame 336.

The manner of operation of the press of FIG. 8 is essentially self evident upon considering the previously described embodiments. Particularly to be mentioned is only that in the event of the lack of a wire segment of correct length between the stamp 301 and the non-illustrated matrix upon running of the roller 326 upon the running surface 330 of the rocker arm 327, the force of the buffer spring 333 prevails compared with the force of the pressure spring 317 effecting the leading positioning of the stamp holder 302, so that the stamp holder 302, in conformity with the rising path of the running surface 330 of the rocker arm 327, is held unmoved relative to the machine frame 336 or relative to the matrix until the pressure sufaces 306 and 307 come into driving contact with each other. In the course of a pressure stroke, during reforming of a wire segment, or in the appropriate last portion of a stroke of the press carriage toward the matrix, the rocker arm 327 is pivoted an appropriate angle from the stamp holder 302 by way of the lever 323 against the force of the buffer spring 333.

Figure 9:
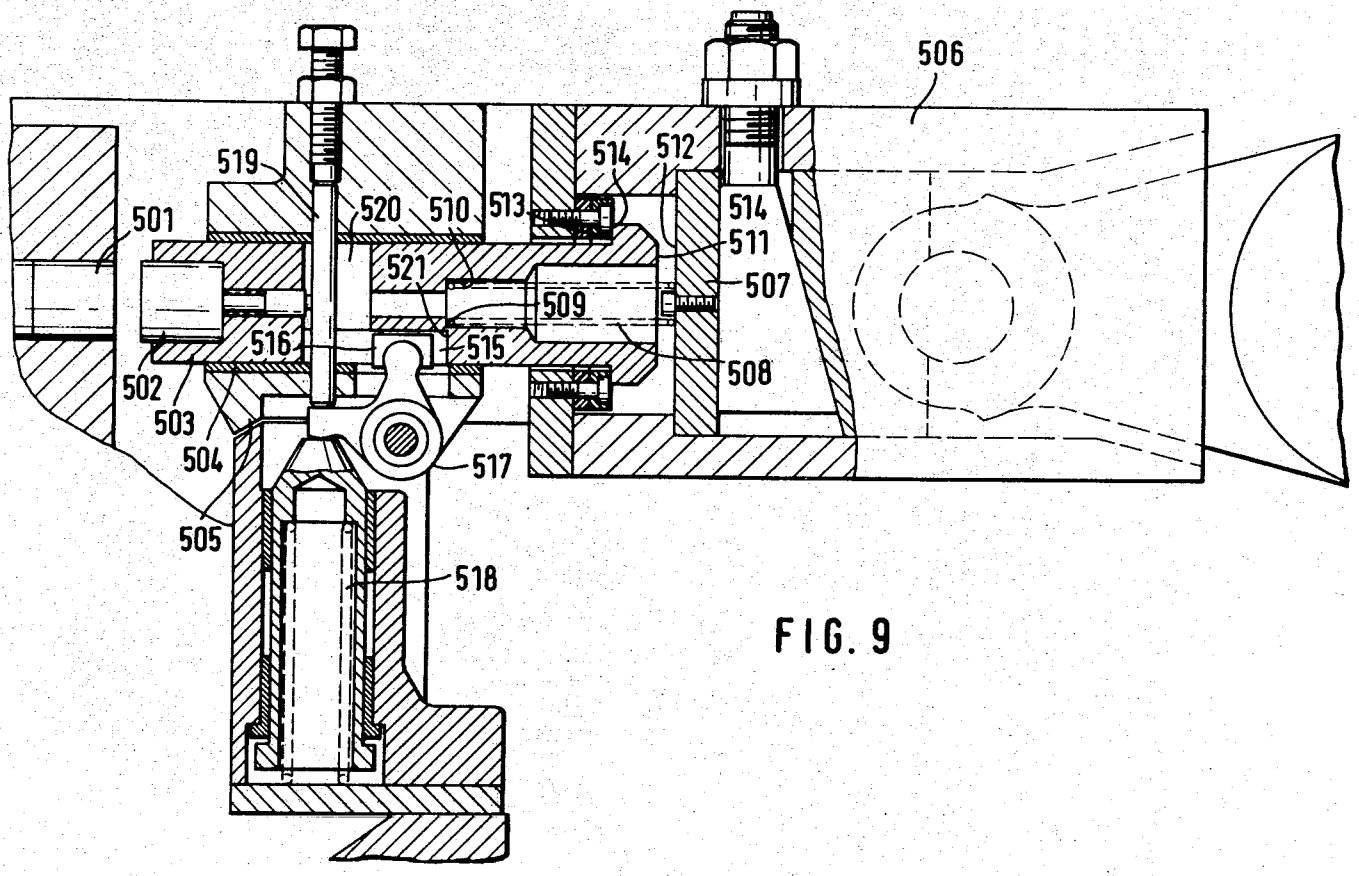
FIG. 9 shows a sectioned side view of a fifth embodiment of a press having features of the present invention similar to the embodiment of FIG. 1.
Figure 10:
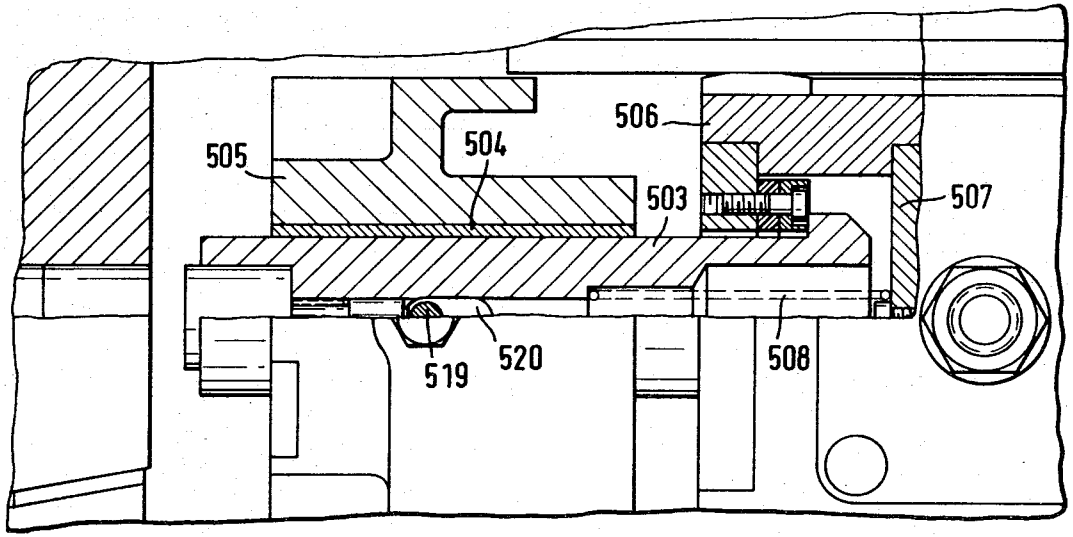
FIG. 10 is a partially sectioned plan view of the press of FIG. 9.

FIGS. 9 and 10 show a press which is very similar to the press of FIGS. 1 and 2. A stamp 502 is located across from a matrix 501, and the stamp 502 is fastened in a stamp holder 503. The stamp holder 503 is located in a sleeve 504 which is fastened in a support insert 505.

One end of the pressure spring 508 engages the plate 507 of the press carriage 506, and the other end of the pressure spring 508 engages the collar 509 of the stamp holder 503. The collar 509 delimits or defines a bore 510 in the stamp holder 503.

The plate 507 forms a pressure surface 512 which is located across from a pressure surface 511 of the stamp holder 503. Abutment surfaces 513 and 514 on the stamp holder 503 and on the press carriage 506 provide a limit of the leading stroke of the stamp holder 503 relative to the press carriage 506 in one direction.

A sliding block 516 is located in a recess 515 of the stamp holder 503. The sliding block 516 is mounted on a lever 517 pivotally journalled in the machine frame. In addition, the lever 517 engages a stationarily supported buffer spring 518. An adjustment pin 519 serves as an adjustable abutment for the buffer spring 518 and the lever 517, and hence for the buffer for the stamp holder 503, which buffer is formed by the sliding block 516. A recess 520 makes possible sufficient axial mobility of the stamp holder 503 relative to the adjusting pin 519 fixed in this direction. A work or effective surface 521 of the stamp holder 503 is located across from the buffer formed by the sliding block 516 and provided with the buffer spring 518.

The operation of the press according to FIGS. 9 and 10 corresponds to the operation of the press according to FIGS. 1 and 2. The differing shape and/or arrangement of certain structural elements has no influence upon the operation of the press.

FIG. 11 shows a cutaway portion of the inventive press, and in particular shows an embodiment corresponding to FIG. 8 of the drawings. Compared with the embodiment of FIG. 8, however, the illustration of FIG. 11 illustrates a change of the arrangement of the coulisse (rocker arm), as described in further detail in the following paragraphs.

The stamp holder 302 of the press is provided with a recess 319 in which a sliding block 320 is positively guided. The sliding block 320 is seated upon a head portion 321 of an arm 322 of the lever 323. The lever 323 is pivotably journalled upon a shaft 324 located in the press carriage.

The lever 323 furthermore has an arm 325, on the free end of which a roller 326 is rotatably journalled on a bearing bolt.

A coulisse (rocker arm) 341 with running surfaces 342 and 343 is associated with the roller 326. These running surfaces 342 and 343 correspond approximately to the running surfaces 329 and 330 of the embodiment according to FIG. 8. Between the running surfaces 342 and 343 there is now provided a transition running surface 344 which in the course of a forward movement of the pressing carriage effects a gradual rising or increase of the forces transmitted into the lever 323 by the roller 326 (the course of the running surfaces 329 and 330 of the embodiment of FIG. 8 is illustrated in the boundary region of both of these running surfaces in FIG. 11 by dashes).

A stop 345 of the coulisse (rocker arm) 341 engages an abutment 355 which is fastened on the machine frame 336. On the other side, a sleeve 332 with a buffer spring 33 engages a stop 346 of the coulisse or rocker arm.

The coulisse or rocker arm 341 is pivotally journalled upon a stationary axis 328 in the machine frame.

FIG. 12 partially shows the lever 323 of the illustration of FIG. 11, and in particular only the arm 325 with the roller 326. In place of the coulisse or rocker arm 341 of FIG. 11, FIG. 12 illustrates a coulisse or rocker arm 441 which is pivotally journalled about a stationary shaft 428 in the machine frame. The coulisse or rocker arm 441 has running surfaces 442 and 443, as well as a transition running surface 444, which corresponds to the running surfaces 342 to 344 of the coulisse or rocker arm 341 of FIG. 11.

Furthermore, for the coulisse or rocker arm 441 there is provided a stationary abutment 435 against which the coulisse 441 suitably engages under the influence of a sleeve 432 with a buffer spring 433.

The embodiment according to FIG. 12 differs from the embodiment of FIG. 11 essentially in that the axis of rotation of the coulisse 441, namely the shaft 428, lies in a region of the coulisse 441 remote from the rear dead center position of the press carriage (not illustrated). Thereby there is attained that the effect of the buffer spring 443 does not decrease because of the changing lever ratio, as is the case with the embodiment of FIG. 11, but rather in contrast thereto the effect of the buffer spring 433 increases. In this manner the advantageous effect attained with the transition running surface 444 (or 344) can be further enhanced, because in this way the forces resulting between the running surfaces 442 to 444 of the coulisse or rocker arm, and the roller 326 in the course of a forward stroke of the press carriage can be maintained gradually still more advantageously and also so as to practically continuously increase.

The present invention is, of course, in no way restricted to the specific disclosure of the specification and drawings, but also encompasses any modifications within the scope of the appended claims.

What I claim is:

1. A press for producing workpieces from wire segments, comprising:

a machine frame;

a stationary matrix mounted in said machine frame;

a press carriage which is drivable back and forth in and opposite to a pressing direction;

a stamp mounted in said machine frame in such a way as to be displaceable in and opposite to the pressing direction and relative to said matrix, said stamp being drivably connected with said press carriage and being adapted to lead same;

first spring means operatively associated with said stamp and said machine frame for effecting leading of said stamp relative to said press carriage;

a feeding device for supplying wire segments between said matrix and said stamp;

a buffer operatively associated with said stamp and said machine frame, said buffer being resiliently yieldable in the pressing direction; and second spring means in the form of a buffer spring mounted between said buffer and said machine frame for supporting said buffer, the spring characteristics and/or preloading of said buffer spring and of said first spring means being coordinated in such a way that upon engagement of a wire segment by said stamp and said matrix, the spring force of said first spring means prevails over the sping force of said buffer spring, and in the course of further movement of said stamp in the pressing direction, the spring force of said buffer spring prevails over the spring force of said first spring means.

2. A press according to claim 1, which includes a stamp holder mounted in said machine frame, said stamp being arranged in said stamp holder, which is provided with an effective surface; and in which said buffer is formed by a lever operatively associated with said effective surface.

3. A press according to claim 2, in which said lever is journalled about a stationary axis.

4. A press according to claim 2, in which said lever is mounted to said press carriage.

5. A press according to claim 4, which includes a rocker arm journalled on said machine frame and associated with said lever.

6. A press according to claim 5, in which said rocker arm is resiliently yieldably journalled on said machine frame.

7. A press according to claim 6, in which said rocker arm is pivotally journalled on said machine frame, and said buffer spring is mounted between said rocker arm and said machine frame.

8. A press according to claim 2, which includes a rocker arm stationarily mounted in said machine frame, and in which said lever comprises a first lever and a second lever, each of which has oppositely located ends, one end of said first lever being under the influence of said buffer spring, and one end of said second lever being associated with said rocker arm.

9. A press according to claim 1, in which said buffer with said buffer spring is arranged at least in the vicinity between said stamp area and said matrix area.

10. A press according to claim 1, which includes a support stationarily mounted in said machine frame, and a stamp holder mounted in said support in such a way as to be displaceable therein in and opposite to the pressing direction, said stamp being fixed in said stamp holder.

11. A press according to claim 10, in which said stamp holder is mounted in said support in such a way as to be releasable from said drive connection with said press carriage transverse to the pressing direction.

12. A press according to claim 10, which includes means mounted in said support for adjusting said buffer.

13. A press according to claim 5, in which said lever is pivotally journalled on said press carriage and is provided with a roller; and in which said rocker arm is provided with two adjoining rolling surfaces for said roller, one of said rolling surfaces extending in the pressing direcion, the other of said rolling surfaces extending at an angle to the pressing direction in such a way as to rise in the pressing direction.

14. A press according to claim 13, in which said rocker arm is additionally provided with a transition rolling surface for effecting connection of said two adjoining rolling surfaces, the curvature of said transition rolling surface being less than the curvature of the rolling surface of said roller of said lever.

15. A press according to claim 14, in which said rocker arm is pivotally and resiliently yieldably journalled in said machine frame, the axis of rotation of said rocker arm being located in a region of said rocker arm remote from the rear dead center position of said press carriage.

* * * * *